United States Patent [19]

Puttinger et al.

[11] 4,031,805

[45] June 28, 1977

[54] APPARATUS FOR EJECTING A TRANSPORT AND LAUNCHING CONTAINER FROM A MISSILE LAUNCHER

[75] Inventors: Dietmar Puttinger, Munich; Manfred Fischer, Ottobrunn, both of Germany

[73] Assignee: Messerschmitt-Boelkow-Blohm GmbH, Munich, Germany

[22] Filed: Nov. 1, 1976

[21] Appl. No.: 737,561

[30] Foreign Application Priority Data

Nov. 11, 1975 Germany ..... 2550587

[52] U.S. Cl. ..... 89/1.5 G; 89/1.816; 244/137 R

[51] Int. Cl.[2] ..... F41F 5/00

[58] Field of Search ..... 89/1.5 G, 1.5 H, 1.5 R, 89/1.816; 244/137 R; 294/83 R

[56] References Cited

UNITED STATES PATENTS

| | | | |
|---|---|---|---|
| 1,480,582 | 1/1924 | Weed | 89/1.5 G |
| 2,699,908 | 1/1955 | Fletcher | 244/137 R |
| 2,830,841 | 4/1958 | Benson et al. | 89/1.5 G X |
| 2,971,792 | 2/1961 | Steinmetz | 89/1.5 R X |
| 3,722,944 | 3/1973 | Dand | 89/1.5 R X |
| 3,877,343 | 4/1975 | Newell et al. | 89/1.5 G X |
| 3,954,233 | 5/1976 | Hasquenoph et al. | 89/1.5 G X |

*Primary Examiner*—David H. Brown

*Attorney, Agent, or Firm*—W. G. Fasse; W. W. Roberts

[57] ABSTRACT

An ejector for the transport container of a missile is used in a missile launcher. The missiles are launched from the container which is then ejected by an ejector mechanism from the launcher proper. The ejector comprises a pair of axially spaced pivoted levers and first spring means for imparting an ejecting movement to said levers and second spring means for returning the levers to a ready position to receive another missile in its container.

6 Claims, 5 Drawing Figures

Fig. 1
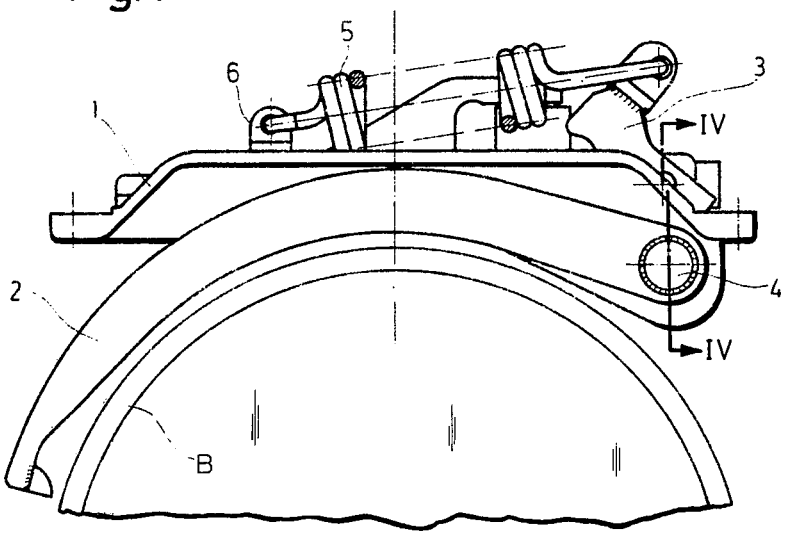
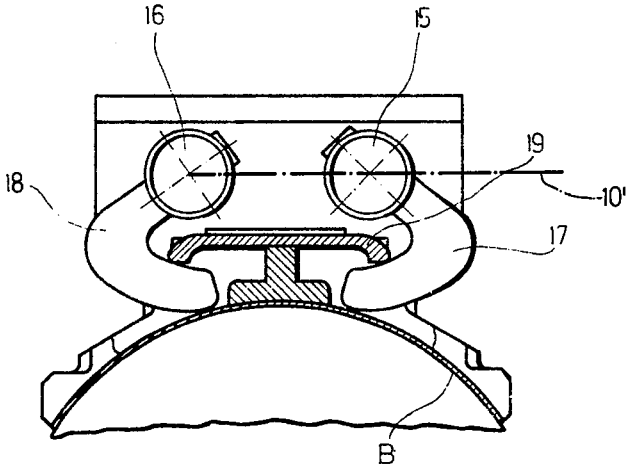
Fig. 2

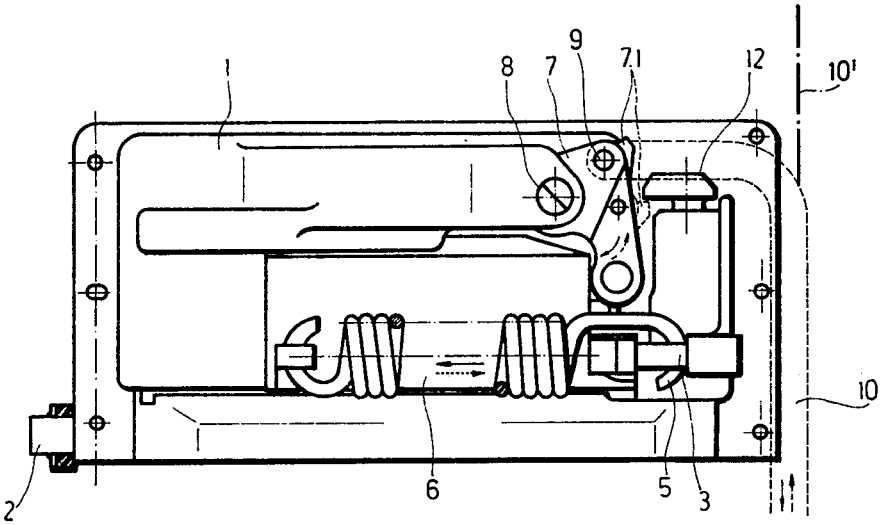
Fig.3
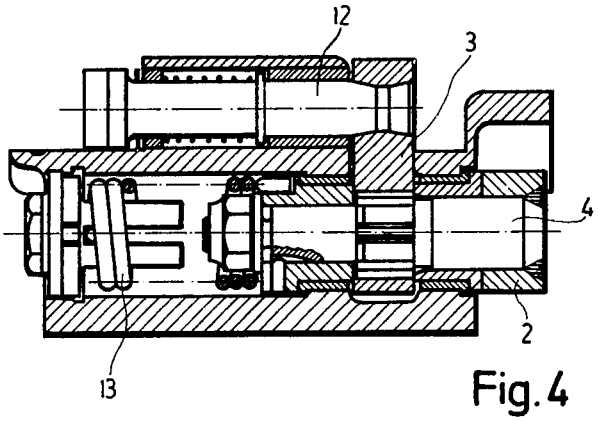
Fig.4
Fig.5
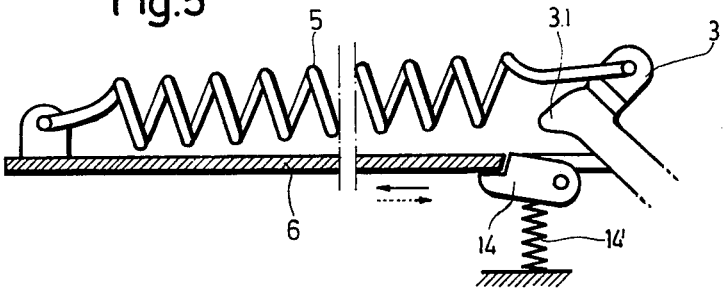

APPARATUS FOR EJECTING A TRANSPORT AND LAUNCHING CONTAINER FROM A MISSILE LAUNCHER

BACKGROUND OF THE INVENTION

The invention relates to an apparatus for ejecting a transport and launching container from a missile launcher. Certain missle launchers are constructed to launch a missile directly from its container in which the missile is transported. Such launchers have means for releasably securing the container and missile in a launching position. After a missile is launched its empty container must be rapidly removed from the launcher by means of a releasable locking mechanism.

German Patent Publication 22,14,745 describes an apparatus of the above described type in which the ejector mechanism includes one or more ejector levers arranged at the ends of a shaft which in turn is connected to a rocker arm or sliding block. The ejector levers are rotated in a motion directed to eject the container out of the launching apparatus, by means of pins engaging the sliding block. For this purpose the pins are moved by a hydraulic device in axial direction relative to the sliding block.

In order to eject the container from the launching apparatus after a flying object such as a missile has been launched, it is necessary to apply a strong thrust to the container by means of ejector levers. The thrust must be sufficient to throw the container away from the launcher without affecting the aiming position of the launcher. The container should always be thrown far enough and fast enough so that rapid reloading of the launcher may proceed without hindrance by the emptied container. However, where an automatic reloading apparatus is used in a limited space, such as in the case with a launcher mounted on an armored vehicle, it has been found that such ejected containers substantially hinder the reloading operation. This hindrance becomes even more pronounced where external forces such as wind and acceleration are effective on the container. Such containers are, for example, 2.5 meters long and have a width of 0.30 meters. Thus, large forces are necessary to assure positive ejection of a container and such large forces must be applied in the prior art by a hydraulic device in a very short time period. Accordingly, it is necessary to use a hydraulic device capable of providing such large forces which is costly. In accordance with these forces, the wear and tear on the force transmitting elements especially the pins and grooves in the sliding block is also great.

OBJECTS OF THE INVENTION

In view of the foregoing it is the aim of the invention to achieve the following objects singly or in combination:

- to provide a launcher having an apparatus for the ejection of containers which ensures that the container is always thrown out to such a distance that hindrance to the reloading is avoided; and
- to provide such an apparatus which is robust and inexpensive and which operates reliably even under battle conditions.

SUMMARY OF THE INVENTION

These objects are achieved according to the invention in that a first spring is connected with one end to the ejector lever to impart a torque moment to the ejector lever for the ejection of the container. The other end of the spring is connected to an anchoring which is shiftable by means of a linkage against the direction of the spring force. The anchoring is lockable by means of a first safety device. The ejector lever is lockable by means of a second safety device. A second spring imparts a torque moment to the ejector lever which torque moment is directed opposite to the torque momemt imparted to the ejector lever by the first spring. The torque moment of the second spring is smaller than that of the first spring. The second safety device is releasable by said linkage, whereby the first safety device is automatically releasable by the relaxing of the first spring.

It is advantageous that the linkage is connected with the locking mechanism by means of which the container is held in a launching apparatus.

BRIEF FIGURE DESCRIPTION

In order that the invention may be clearly understood, it will now be described, by way of example, with reference to the accompanying drawings, wherein:

FIG. 1 is a side view of an ejector device according to the invention whereby the view direction is substantially in the direction of the longitudinal axis of a container;

FIG. 2 is a sectional view through a portion of a container and its locking mechanism;

FIG. 3 is a plan view of the ejector device;

FIG. 4 is a sectional view along section line 4—4 in FIG. 1 through the ejector device whereby the section plane extends in the rotational axis of the ejector lever; and FIG. 5 is a detail of the safety mechanism of the anchoring for a first spring.

DETAILED DESCRIPTION OF PREFERRED EXAMPLE EMBODIMENTS

The ejector device is illustrated in FIG. 1 in a side view looking in the direction of the longitudinal axis of a missile container B. The ejector is mounted on a base plate 1. Two of these ejector devices are mounted on a missile launcher in such a manner that an ejector lever 2 is located to engage a respective end of a tubular container B. The container B is held in a central area by means of a locking mechanism or releasable securing mechanism shown in FIG. 2. The locking mechanism comprises hook shaped lock bolts 17, 18 rotatably supported on pivots 15, 16. The bolts engage beneath a T-sectional rail 19 which is secured to the outside of the container B. By rotating the pivots 15, 16 the container B is released by rods 10′ connected to linkage means 10.

The ejector lever 2 of one ejector device is secured, together with a lever 3, on a pivot axis 4 which is mounted for rotation in appropriate bearings, the levers 2 and 3 together constituting ejector lever means. A coil spring 5 is connected at one end thereof to the free end of the lever 3 and has its opposite end connected to a displaceable anchoring means 6. The spring 5 imparts an ejecting movement to said lever means as will be described in more detail below.

As illustrated in FIG. 3, the anchor means 6 is shiftable in the direction of the arrows, by means of a lever 7 which is rotatably supported on a pivot axis 8 which is secured to the base plate 1. The anchor means 6 is shiftable by means of a linkage 10 connected to the lever 7 at pivot 9. Lever 7 is provided with an anti-friction roller at the end thereof contacting said anchor.

As shown in FIG. 4, the ejector lever 2 is lockable by means of safety device 12 which projects or catches into an opening of the lever 3. A second spring 13 applies a torque to the pivot 4 which torque is directed opposite to the direction applied to the pivot by the spring 5. However, the torque applied to the pivot by spring 13 is smaller than the torque applied to the pivot by the spring 5.

A partial view of the ejector device is illustrated in FIG. 5. The partial view shows the lever 3, the first spring 5, the anchor means 6 and a catch element 14, which serves for holding the anchor means 6. The catch element 14 is rotatably secured to the base plate 1 and engages an abutment formed by a recess of the anchor means 6, when the spring 5 is loaded by shifting the anchor means 6 in the direction indicated by the full line arrow shown in the drawing. The safety device 14 is released by the projection 3.1 formed on lever 3 as will be described below.

The function of the illustrated ejector device will now be described. The ejector lever 2 is held in the rest position shown in FIG. 1 by the safety device 12 which blocks the lever 3 and thus the pivot 4. The spring 5 is relaxed and the anchor means 6 is pulled back whereby the safety catch 14 is held in a position below the anchor means 6, thereby loading a spring 14'.

For preparing the ejecting of the container B shown in FIG. 1 the linkage 10, shown in dashed lines in FIG. 3 is first pulled downwardly as indicated by the full line arrow in FIG. 3. Where several ejector devices are involved, the respective linkages 10 would be interconnected for their simultaneous actuation. The down pulling motion is transmitted through the lever 7 to the anchor means 6 which moves in the direction indicated by the full line arrow, thereby cocking the spring 5. The anchor means 6 is thus shifted to such an extent that the safety catch 14 engages the anchor means 6, whereby the catch 14 is moved under the influence of the spring which is indicated schematically at 14'. Thus, the position shown in FIG. 5 is accomplished, i.e., a ready to operate position is achieved. During the loading, a catch 7.1 engages below a projection of the safety device 12. The catch 7.1 is spring biased on the lever 7.

For ejecting the container B to the right in FIG. 1, the ejector lever 2 must move counterclockwise. For this purpose the linkage 10 is shifted in the direction of the dashed line arrow, whereby the safety device 12 is pulled out of the recess in the lever 3 by the catch 7.1 of the lever 7. As soon as the lever is free, the spring 6 contracts, thereby pulling the lever 3 toward the spring 5 so that the ejector lever 2 is forcefully pivoted outwardly by means of the lever 3 which rotates the shaft 4 counterclockwise, in this way ejecting the container B just as soon as the latter is released from the locking device 17, 18. Just before the spring 5 is completely relaxed, the projection 3.1 of the lever 3 reaches the catch or safety device 14 to release it from the anchor means 6 which may then be shifted in the direction indicated by the dotted line arrow.

The spring 5 is now completely relaxed and the levers 2 and 3 are in their operated position. The weaker spring 13 is cocked by the rotational movement of the shaft 4 and as the catch 14 is relased from the anchor means 6, only the force of the spring 13 is applied to the shaft 4. The spring 13 now relaxes, returning the ejector levers 2 and 3 back into the starting position shown in FIG. 1 by the clockwise rotation of the shaft 4 whereby the anchor means 6 is returned in the direction of the dotted line arrow. The return motion is completed as soon as the safety device 12 projects into the recess of the lever 3.

It is an advantage of the apparatus according to the invention, that it accomplishes an ejector operation by means of a simple back and forth movement of a linkage which ejects the container independently of the forces effective on the linkage, said ejection always taking place in a positive manner. Since the linkage is subjected only to tension loads it is possible to avoid the use of a heavy linkage means such as was necessary with prior art devices. Furthermore, costly guide means have been avoided. Since the container holding the missile is connected to the launching apparatus by means of a releasable mechanism it is practical that the pulling motion of the linkage 10 simultaneously releases the securing elements 17, 18 through a connection indicated schematically in chain-dot line at 10', so that the container is completely free immediately following the releases of the ejector operation resulting from the pullback of the linkage 10 etc. and the release of the safety device 12.

Although the invention has been described with reference to specific example embodiments, it will be appreciated, that it is intended to cover all modifications and equivalents within the scope of the appended claims.

What is claimed is:

1. In an apparatus for ejecting a missile container from a missile launcher, including a pivoted ejector lever means movable between a first, ready to operate position and a second operated position; the improvement comprising movable anchor means, first spring means coupled between said movable anchor means and said ejector lever means, actuating means comprising means for moving said anchor means to load said first spring means and thereby apply a first torque to said ejector lever means in the direction to move said ejector lever means to said second position thereof for ejecting said container, first catch means coupled to said anchor means for holding said first spring means in a loaded state, second catch means for holding said ejector lever means at said first position thereof, said actuating means further comprising means for releasing said second catch means for movement from said first position to said second position, means responsive to movement of said ejector lever means to said second position for releasing said first catch means, and second spring means coupled to apply a second torque to said ejector lever means in a direction to move said ejector lever means to said first position thereof, said second torque being smaller than said first torque, whereby said second spring means move said ejector lever means to said first position only in response to release of said first catch means.

2. The apparatus of claim 1, comprising means for releasably securing a container in a launching position in said launching apparatus, said actuating means further comprising means (10') for releasing said releasable securing means.

3. The apparatus of claim 1, wherein said ejector lever means comprises a shaft, and an ejector lever fixedly mounted on said shaft, said means responsive to movement of said ejector lever for releasing said first catch means comprising a release lever means affixed to said shaft.

4. The apparatus of claim 3, wherein said actuating means comprises an actuating lever pivotally mounted on said missile launcher and positioned to engage said movable anchor means, said means for releasing said second catch means comprising a spring biased catch mounted on said actuating lever, said spring biased catch being positioned to engage said second catch means.

5. The apparatus of claim 4, wherein said actuating lever is positioned to move said movable anchor means to load said first spring means upon rotation thereof in one direction, said spring biased catch being positioned to release said second catch means only in response to rotation of said actuating lever in the other direction of rotation thereof.

6. The apparatus of claim 5, wherein said ejector lever means comprises a shaft and an ejector lever rotatable with said shaft, and further comprising an arm affixed to said shaft, said arm having an aperture, said second catch means comprising pin means resiliently engaging said aperture to inhibit rotation of said shaft, said spring biased catch being positioned to withdraw said pin means from said aperture upon rotation of said actuating lever in said opposite direction.

* * * * *